US009242825B2

(12) United States Patent
Foerch et al.

(10) Patent No.: US 9,242,825 B2
(45) Date of Patent: Jan. 26, 2016

(54) APPARATUS FOR REMOVING SHEETS

(71) Applicant: HEIDELBERGER DRUCKMASCHINEN AG, Heidelberg (DE)

(72) Inventors: Peter Foerch, Neustadt (DE); Markus Moehringer, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/485,844

(22) Filed: Sep. 15, 2014

(65) Prior Publication Data

US 2015/0076762 A1 Mar. 19, 2015

(30) Foreign Application Priority Data

Sep. 13, 2013 (DE) ..... 10 2013 015 211

(51) Int. Cl.

| | |
|---|---|
| ***B65H 29/24*** | (2006.01) |
| ***B65H 3/12*** | (2006.01) |
| ***B65H 5/22*** | (2006.01) |
| ***B65H 29/68*** | (2006.01) |
| ***B65H 29/04*** | (2006.01) |
| ***B65H 29/06*** | (2006.01) |
| ***B65H 29/62*** | (2006.01) |
| ***B65H 31/10*** | (2006.01) |

(52) U.S. Cl.

CPC ..... *B65H 29/243* (2013.01); *B65H 3/128* (2013.01); *B65H 5/224* (2013.01); *B65H 5/226* (2013.01); *B65H 29/041* (2013.01); *B65H 29/06* (2013.01); *B65H 29/242* (2013.01); *B65H 29/62* (2013.01); *B65H 29/686* (2013.01); *B65H 31/10* (2013.01); *B65H 2301/44712* (2013.01); *B65H 2301/44714* (2013.01); *B65H 2301/44734* (2013.01); *B65H 2406/323* (2013.01); *B65H 2701/121* (2013.01); *B65H 2801/21* (2013.01)

(58) Field of Classification Search

CPC .. B65H 29/241; B65H 29/242; B65H 29/243; B65H 29/686; B65H 29/06; B65H 29/041; B65H 2406/323; B65H 231/44714; B65H 231/44734

USPC ..... 271/303

See application file for complete search history.

(56) References Cited

U.S. PATENT DOCUMENTS

| | | | | |
|---|---|---|---|---|
| 4,716,828 | A | 1/1988 | Hartung et al. | |
| 6,000,695 | A * | 12/1999 | Mack et al. | 271/303 |
| 7,726,651 | B2 | 6/2010 | Boettger et al. | |
| 8,141,873 | B2 * | 3/2012 | St. Ours et al. | 271/303 |

(Continued)

FOREIGN PATENT DOCUMENTS

| | | |
|---|---|---|
| DE | 6608024 U | 6/1971 |
| DE | 3529598 A1 | 2/1987 |

(Continued)

*Primary Examiner* — Patrick Cicchino

(74) *Attorney, Agent, or Firm* — Laurence Greenberg; Werner Stemer; Ralph Locher

(57) ABSTRACT

An apparatus for removing sheets from a transport path of a sheet-processing machine for depositing the sheets onto an auxiliary stack, includes a delivery drum for removing the sheets from the transport path upstream of a main stack, as viewed in the transport direction, and depositing the sheets onto an auxiliary stack in a manner which is retarded by using a suction belt transport system and a suction belt brake system which is associated with the latter. The suction belt transport system and the suction belt brake system are disposed above the auxiliary stack.

10 Claims, 3 Drawing Sheets

(56) References Cited

U.S. PATENT DOCUMENTS

| | | | | |
|---|---|---|---|---|
| 2004/0135312 | A1* | 7/2004 | Becker et al. | 271/275 |
| 2006/0244204 | A1 | 11/2006 | Bottger et al. | |

FOREIGN PATENT DOCUMENTS

| | | | | |
|---|---|---|---|---|
| DE | 4322324 | A1 | 1/1995 | |
| DE | 4442557 | A1 * | 6/1996 | B41F 23/04 |
| DE | 19819491 | C1 | 6/1999 | |
| DE | 10222542 | A1 | 11/2003 | |
| DE | 102006015578 | A1 | 11/2006 | |
| DE | 102006052367 | B3 | 2/2008 | |
| DE | 102008006528 | A1 | 8/2008 | |
| GB | 2336837 | A | 11/1999 | |

* cited by examiner

APPARATUS FOR REMOVING SHEETS

CROSS-REFERENCE TO RELATED APPLICATION

This application claims the priority, under 35 U.S.C. §119, of German Patent Application DE 10 2013 015 211.9, filed Sep. 13, 2013; the prior application is herewith incorporated by reference in its entirety.

BACKGROUND OF THE INVENTION

Field of the Invention

The invention relates to an apparatus for removing sheets from a transport path of a sheet-processing machine, for example a punch or a printing press.

In the delivery of a punch or printing press, sheets are fed one after another to a sheet stack and are deposited onto the latter.

Deliveries are already known, in which sheets, before they are deposited onto the sheet stack, are removed from a transport path and are deposited onto an auxiliary stack.

German Patent Application DE 10 2008 006 528 A1, corresponding to U.S. Pat. No. 7,726,651, discloses an apparatus for combing out a sheet from a transport path between the printing units of a printing press and a sheet stack, in which the sheet which has been combed out is fed to an auxiliary stack by using a transport belt which brakes the sheet.

German Patent DE 198 19 491 C1, corresponding to UK Patent Application GB 2 336 837 A, discloses a delivery drum which accepts a sheet from the transport path by using gripper systems and feeds the sheet in an unbraked manner to a stack or deposition system.

SUMMARY OF THE INVENTION

It is accordingly an object of the invention to provide an apparatus for removing sheets, which overcomes the hereinafore-mentioned disadvantages of the heretofore-known apparatuses of this general type, which has a delivery drum for removing sheets from a transport path of a sheet-processing machine and which permits the sheets to be fed in a braked manner to an auxiliary stack.

With the foregoing and other objects in view there is provided, in accordance with the invention, an apparatus for removing sheets from a conveying section onto an auxiliary stack of a sheet-processing machine. The apparatus comprises a delivery drum having gripper devices configured to deposit the sheets from the conveying section onto the auxiliary stack, a suction belt transport system associated with the delivery drum and disposed above the auxiliary stack, and a sheet brake device associated with the delivery drum.

It is a special advantage of the invention that the sheets are braked before being deposited onto the auxiliary stack. By way of this measure, a precise stack formation can be achieved which makes precise further processing possible.

Another special advantage is the use of a suction belt brake, in which a number of (at least two) driven suction belts which are disposed next to one another are provided, and in which the suction belts suction a rear edge of a sheet which is removed from a transport path by a spoilage drum, and brake the sheet to a slow depositing speed.

A sinusoidally running drive profile for the suction belts makes it possible to brake a sheet from a high processing speed to a low depositing speed.

In this case, the suction belt brake is disposed above a sheet, with the result that the suction belt brake acts on the sheet from above.

Other features which are considered as characteristic for the invention are set forth in the appended claims.

Although the invention is illustrated and described herein as embodied in an apparatus for removing sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
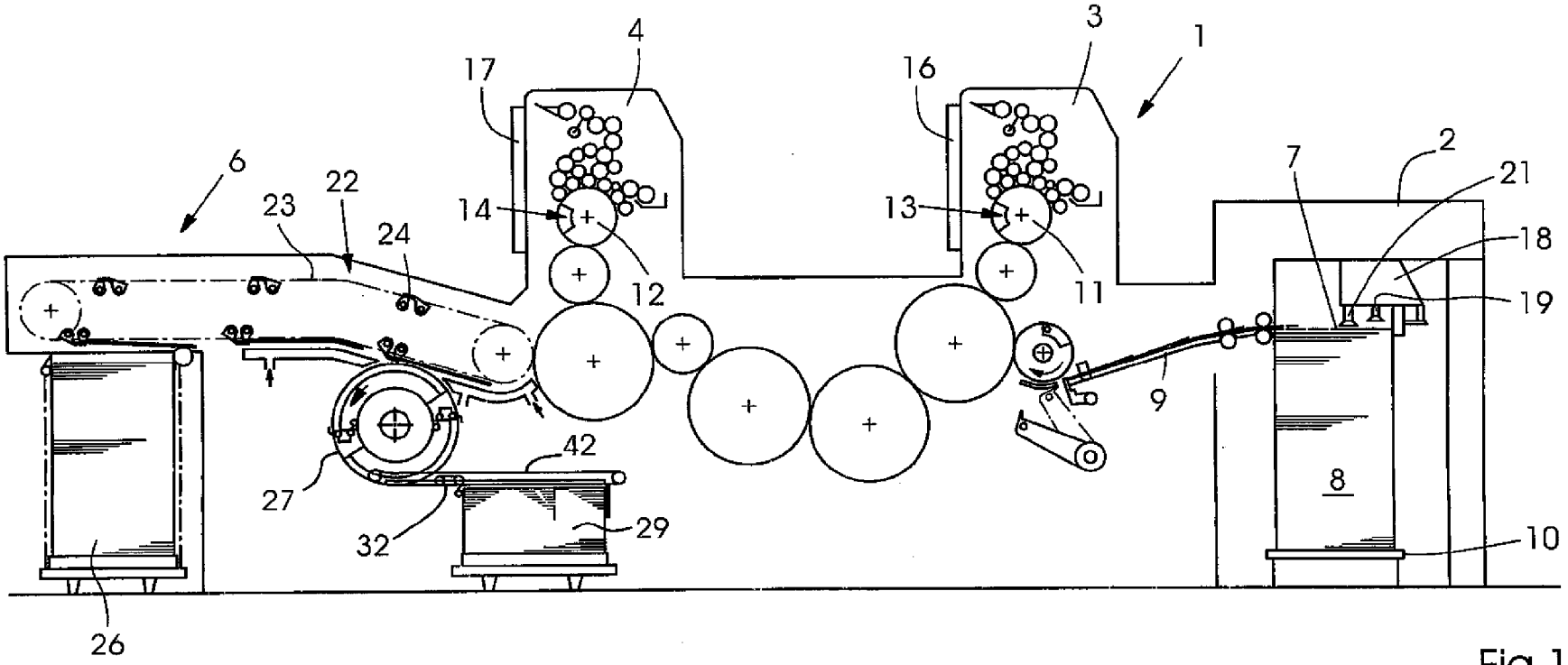
FIG. 1 is a diagrammatic, longitudinal-sectional view of a sheet-fed rotary printing press.

Referring now to the figures of the drawings in detail and first, particularly, to FIG. 1 thereof, there is seen an exemplary embodiment of a machine which processes sheets 7, for example a printing press 1 or punch, having a feeder 2, at least one printing unit 3 and 4 and a delivery 6. The sheets 7 are removed from a sheet stack 8 and are fed in a separated or overlapping manner over a feed table 9 to the printing units 3 and 4. As is known, the printing units 3 and 4 each include a plate cylinder 11, 12. The plate cylinders 11 and 12 each have an apparatus 13, 14 for fastening flexible printing plates. Moreover, each plate cylinder 11, 12 is assigned an apparatus 16, 17 for semi-automatic or fully automatic printing plate changing.

The sheet stack 8 lies on a main stack board 10 which can be raised in a controlled manner. The removal of the sheets 7 takes place from the upper side of the sheet stack 8 by using a so-called suction head 18 which, inter alia, has a number of lifting and dragging suckers 19, 21 for separating the sheets 7. Moreover, blowing devices are provided for loosening the upper sheet layers of the sensing elements for stack tracking. A number of lateral and rear stops are provided for orienting the sheet stack 8, in particular the upper sheets 7 of the sheet stack 8.

The delivery 6 has a conveying section 22 which is formed of a gripper chain system 23 with gripper bars 24 for transporting sheets to a main stack 26 of the delivery 6.

Figure 2:
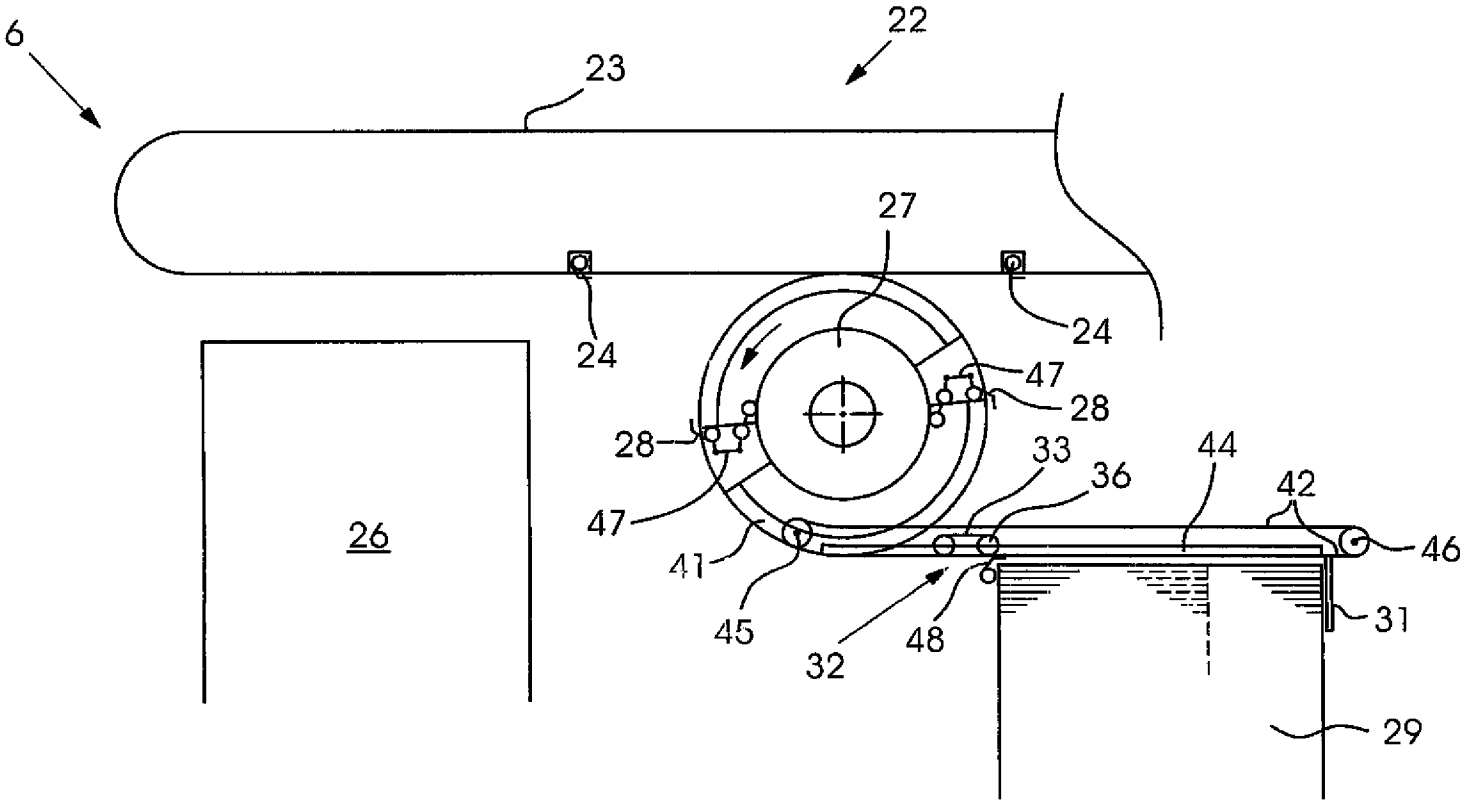
FIG. 2 is an enlarged, fragmentary, longitudinal-sectional view of a delivery of the sheet-processing machine.

Upstream of the main stack 26 in the sheet transport direction, an apparatus for removing sheets from the conveying section 22 is provided below the conveying section 22 which is defined by the gripper chain system 23. As is seen in FIG. 2, the apparatus includes substantially a sheet transport drum 27 which is configured as a delivery drum with at least one gripper device 28 for receiving the sheets from the gripper bars 24 of the gripper chain system 23. The gripper devices or grippers 28 grip the sheet on its front edge and convey it onto an auxiliary stack 29 which is disposed adjacent the delivery drum 27. Apparatuses, for example stops 31 for correct stack formation, are provided.

The delivery drum 27 has channels 41 which are spaced apart axially from one another and into which suction belts 42 dip, in order to suction a sheet on its side which faces the delivery drum 27 and feed it to the auxiliary stack 29. The suction belts or suction belt transport 42 reaches far enough to extend over the auxiliary stack 29.

Figure 3:
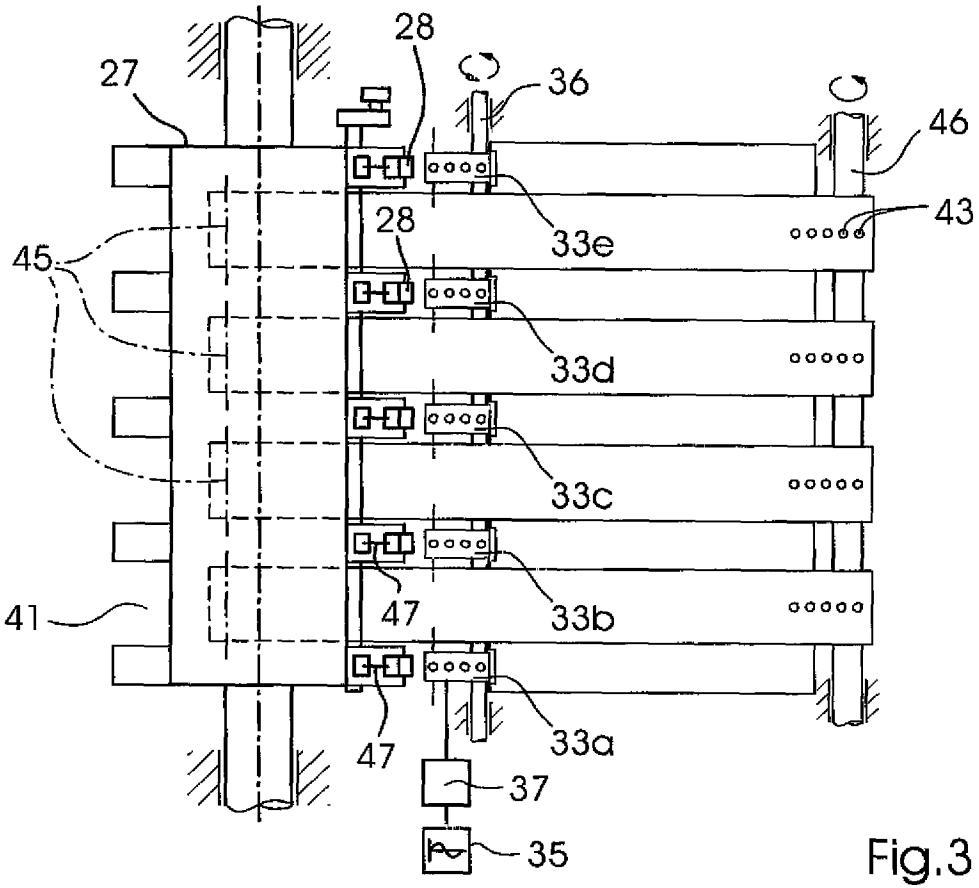
FIG. 3 is a plan view of a delivery drum and a depositing system disposed downstream thereof.

Suction openings 43 (see FIG. 3) which are disposed in the suction belts 42 are supplied with vacuum in each case by using a suction box 44 which is assigned to each suction belt 42, is disposed above the auxiliary stack 29 and is connected to a vacuum source. A drive shaft 46 and deflection rollers 45 for the suction belts 42 are mounted in the suction boxes 44. The drive shaft 46 is driven synchronously with the sheet-processing machine or by an auxiliary motor.

Brake devices 32 are likewise disposed above a sheet to be delivered and are disposed in each case on the side of the suction belts 42.

The suction belt brake device or sheet brake 32 is assigned to the delivery drum 27 in order to ensure that the sheet which is to be removed from the conveying or transport section 22 can be conveyed onto the auxiliary stack 29 at a depositing speed which is reduced with respect to a processing speed. According to FIG. 3, a suction belt brake 32 is formed substantially of a suction belt configuration with at least two suction belts 33*a* to 33*e* which are disposed so as to be spaced apart from one another, can be motor-driven and are disposed on a common drive shaft 36. The drive shaft 36 is driven by an electric motor 37. The drive motor 37 drives the drive shaft 36 with a sinusoidal speed profile 35, in order to ensure that a sheet which is received by the suction belt brake 32 at a processing speed of the sheet-processing machine can be braked down to a depositing speed.

A sheet which is removed on the basis of a signal, for example after an in-line inspection, is transferred by the transport or spoilage drum 27 at the sheet transport speed to the suction belts 42. In this case, the sheet is held partially in its front region by the suction belt 42. In its rear region, the sheet is attracted by suction and braked by the dynamic suction belts 33*a*-33*e* acting as sheet brakes. The holding force of the sheet brakes 33 is higher than the suction belt holding force in the front region of the sheet. As a result, the sheet is released gently by the suction belt 42 during the braking operation.

A hold-down 48 at the rear sheet edge is moved downward synchronously with the sheet-processing machine, in order to guide the sheet at its rear edge downward onto the auxiliary stack 29 and to prevent the rear sheet edge from coming into contact with a following sheet.

In order to ensure a smooth-running transfer, the suction belt 42 is disposed within the periphery of the transport or spoilage drum 27.

An actuating shaft for the grippers 28 of the transport or spoilage drum 27 advantageously has a four-bar linkage 47.

The invention claimed is:

1. An apparatus for removing sheets from a conveying section onto an auxiliary stack of a sheet-processing machine, the apparatus comprising:

a delivery drum having grippers configured to transfer the sheets from the conveying section to the auxiliary stack;

a suction belt transport associated with said delivery drum and disposed above the auxiliary stack, said suction belt transport including suction belts, said suction belts reaching far enough to extend over the auxiliary stack; and a sheet brake associated with said delivery drum, said sheet brake being a suction belt brake device, said sheet brake including a plurality of sheet brakes each disposed laterally alongside a respective one of said suction belts.

2. The apparatus according to claim 1, wherein said delivery drum has channels formed therein transversely relative to a sheet transport direction for receiving said suction belt transport.

3. The apparatus according to claim 2, wherein said suction belt transport is disposed in said channels within a periphery of said delivery drum.

4. The apparatus according to claim 1, wherein said sheet brake is disposed in front of and above said auxiliary stack.

5. The apparatus according to claim 1, wherein said sheet brake is configured to be driven with a sinusoidal speed profile.

6. The apparatus according to claim 1, wherein said grippers of said delivery drum each have a respective four-bar linkage.

7. The apparatus according to claim 1, wherein the sheet-processing machine is a punch.

8. The apparatus according to claim 1, wherein the sheet-processing machine is a rotary printing press.

9. The apparatus according to claim 1, wherein said sheet brake is disposed above the auxiliary stack and acts on a sheet from above.

10. The apparatus according to claim 1, wherein said sheet brakes are configured to have a holding force that is higher than a suction belt holding force in a front region of the sheet.

* * * * *